US005755330A

United States Patent [19]

Siragusa et al.

[11] Patent Number: 5,755,330

[45] Date of Patent: May 26, 1998

[54] MULTIPLE COMPACTED SOLIDS AND PACKAGES THEREOF

[75] Inventors: Nicholas D. Siragusa, Brooklyn, N.Y.; Kenneth J. Ward, Dumont; Deborah A. Sarasohn, Elizabeth, both of N.J.; Ernest Bernarducci, Rutherford, N.J.; Arthur Sternheimer, Spring Valley, N.Y.

[73] Assignee: Block Drug Company, Inc., Jersey City, N.J.

[21] Appl. No.: 828,597

[22] Filed: Mar. 31, 1997

Related U.S. Application Data

[63] Continuation of Ser. No. 446,412, May 22, 1995, abandoned.

[51] Int. Cl.[6] ..... B65D 85/84

[52] U.S. Cl. ..... 206/524.1; 206/219; 206/221; 206/569

[58] Field of Search ..... 206/219, 221, 206/222, 524.1, 538, 569; 383/37, 38; 220/23.8

[56] References Cited

U.S. PATENT DOCUMENTS

| | | | |
|---|---|---|---|
| 2,015,972 | 10/1935 | Sodergren | 383/38 |
| 2,357,339 | 9/1944 | Mathieu | 383/38 |
| 2,566,122 | 8/1951 | Denison | 383/38 |
| 3,272,324 | 9/1966 | Schneider et al. . | |
| 3,530,917 | 9/1970 | Donovan | 220/23.8 |
| 3,545,934 | 12/1970 | Dryden et al. | 220/23.8 |
| 3,680,689 | 8/1972 | Grundschober et al. . | |
| 3,889,804 | 6/1975 | Ravich . | |
| 3,891,138 | 6/1975 | Glas . | |
| 4,200,606 | 4/1980 | Kitko | 422/37 |
| 4,248,827 | 2/1981 | Kitko | 422/37 |
| 4,249,274 | 2/1981 | Kitko | 4/227 |
| 4,308,625 | 1/1982 | Kitko | 4/228 |
| 4,420,412 | 12/1983 | Wong | 252/186.38 |
| 4,460,490 | 7/1984 | Barford et al. . | |
| 4,568,207 | 2/1986 | Hara et al. . | |
| 4,578,207 | 3/1986 | Holdt et al. | 252/134 |
| 4,595,536 | 6/1986 | Hung et al. | 260/394 |
| 4,597,941 | 7/1986 | Bottom et al. . | |
| 4,668,475 | 5/1987 | Meloy | 422/37 |
| 4,683,072 | 7/1987 | Holdt et al. . | |
| 4,790,429 | 12/1988 | Fukushima . | |
| 4,800,066 | 1/1989 | Sinclair et al. | 422/55 |
| 4,820,449 | 4/1989 | Menke et al. . | |
| 4,850,489 | 7/1989 | Weithmann et al. | 206/538 |
| 5,178,787 | 1/1993 | Hung et al. . | |
| 5,358,118 | 10/1994 | Thompson et al. | 206/538 |

*Primary Examiner*—David T. Fidei

*Attorney, Agent, or Firm*—Ostrolenk, Faber, Gerb & Soffen, LLP

[57] ABSTRACT

A package for containing two automatic toilet bowl cleaners, one containing a bleaching cleaner and the other containing a detergent cleaner and a fragrance or dye susceptible to degradation by the bleaching agent, has separate pouches to separate the solids. The pouches open in concert to allow simultaneous dispensing of the solids. In operation, the water in the toilet cistern and bowl is cleaned both by the detergent and the bleaching agent, and the fragrance or dye is not affected by the bleaching agent.

6 Claims, 2 Drawing Sheets

MULTIPLE COMPACTED SOLIDS AND PACKAGES THEREOF

This is a continuation of application Ser. No. 08/446,412, filed May 22, 1995 abandoned.

BACKGROUND OF THE INVENTION

1. Field of the Invention

The invention relates to automatic toilet bowl cleaners and to packages therefor, although the packages are useful for any incompatable solids, including other household cleaner applications.

2. Description of Related Art

Automatic toilet bowl cleaners have been used for many years to clean toilet bowls. The cleaners are usually purchased in the form of a solid puck or block and are placed in the cistern or resevoir of a toilet. As the solid dissolves over time, it releases various cleaning agents to the cistern. The cleaning agents are transferred to the toilet bowl upon flushing, and the fresh water introduced into the cistern dissolves additional cleaning agents from the solid.

Automatic toilet bowl cleaners typically fall into two well-defined formulations: (a) pucks or blocks that deliver halogen, acids or other bleaching agents and (b) pucks or blocks that deliver detergent materials, such as surfactants, and dyes or coloring agents that give an aesthetic color to the water in the toilet bowl. The halogen pucks usually comprise hydantoins that slowly chlorinate or brominate the surrounding water. Such pucks are described in, for example, U.S. Pat. No. 5,178,787 to Hung et al., issued Jan. 12, 1993. Detergent blocks usually comprise surfactant materials, a dye, typically a blue dye, and, optionally fragrance materials. Such blocks are described in, for example, U.S. Pat. No. 4,820,449 to Menke et al., issued Apr. 11, 1989.

For ease of reference herein, the former type of automatic toilet bowl cleaner shall be referred to as a bleach puck and the latter type as a detergent block. Persons skilled in the art will recognize that no limitation as to the shape of the cleaners should be inferred from these names. The cleaners may take any desired shape. Indeed, one commercial detergent "block" is offered for sale in the shape of a duck. Most products, however, are offered for sale in the form of a rounded puck or a rectilinear block.

Just as those skilled in the art will not infer a given shape from the names of the cleaners, neither will those skilled in the art draw any inference regarding the specific formulations contemplated by the names. Bleach pucks may comprise any agent for cleaning toilets or killing germs that will react with the dye, fragrance or any other agent present in a detergent block. While most commercial detergent blocks comprise surfactants and other mild cleaning agents that do not degrade the dye normally found in such products, it is possible to have a "detergent" block that does not have detergents. All that is required is that one ingredient, usually the active cleaning ingredient, of the bleach puck degrade at least one agent of the detergent block, such as a dye or fragrance, if the two solid forms are in physical contact.

Several attempts have been made to combine the two types of automatic toilet bowl cleaners. In one attempt, U.S. Pat. No. 4,460,490 to Barford et al., issued Jul. 17, 1984, the two types were simply joined together forcibly to be sold to the consumer as a single unit. One type of cleaning block is simply imbedded in or adhered to the other type of cleaning block. The patent acknowledges that the bleaching agent of the bleach tablet may discolor the dye in the detergent block.

But, the patent suggests that this problem may simply be ignored. In the alternative, the patent suggests sandwiching a coating or liner of a water soluble or water dispersible material between the two intimately joined tablets. The manufacturing difficulties of attaching these two separate and incompatable materials are readily apparent.

Another attempt is shown in U.S. Pat. No. 4,568,207 to Holdt et al., issued Mar. 25, 1986, (Holdt I) and U.S. Pat. No. 4,683,072 to Holdt et al., issued Jul. 28, 1987, (Holdt II). In these patents, a single block or tablet has a single substrate containing a surfactant. Other ingredients are incorporated into separate regions of the single block or tablet. One region has a dye and a fragrance, while another region has either (a) a chlorine releasing agent or (b) a peroxide bleaching agent or an acid (Holdt I and Holdt II, respectively). The manufacturing difficulties inherent in making such a combination product are also apparent.

U.S. Pat. No. 4,597,941 to Bottom et al., issued Jul. 1, 1986, is another attempt to solve the problem by using a two-chambered dispenser as well as a bleach resistant dye. Unfortunately, the consumer must periodically either replace or "reload" the dispenser, which may prove to be inconvenient or unpleasant.

Thus there is still a strong need in the art for a combination product that is effective in use and that does not degrade due to chemical interaction during storage. The combination product must also be simple to manufacture and must be easy for the consumer to use. We have discovered that the solution to the problem lies both in the formulation used and in the packaging of the combination product.

SUMMARY OF THE INVENTION

The principal object of the present invention therefore is to provide an automatic toilet bowl cleaner that delivers both the cleaning action of a bleach puck and the cleaning and aesthetic aspects of a detergent cube without discoloring the dye during storage or use.

Another object of the invention is to provide a package for holding two incompatable solids, preferably a bleach puck and a detergent block, so that they are separated during storage yet still used together when the package is opened.

Additional objects and advantages of the invention will be set forth in part in the description that follows, and in part will be obvious from this description, or may be learned by practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, the invention provides an automatic toilet bowl cleaner comprising a bleach puck and a detergent block that are separately packaged during storage and that work together in the toilet tank to provide bleach, detergents, and, optionally, dye and fragrance, to the toilet tank.

To further achieve the foregoing objects and in accordance with the purpose of the invention, as embodied and broadly described herein, the invention provides a retail package for preventing contact between at least two solids that are incompatible when in mutual contact, comprising a first sealed pouch for the first solid and a second sealed pouch for a second solid. The first pouch and the second pouch are joined by a unitary attachment and are capable of being opened simultaneously. To use the combination product, the consumer simply opens the two pouches, preferably simultaneously, and drops the two cleaners into the cistern or resevoir. The consumer need not touch the water or the product.

BRIEF DESCRIPTION OF THE DRAWINGS

While this specification concludes with claims particularly pointing out and distinctly claiming that which is regarded as the present invention, the objects and advantages of this invention may be more readily ascertained from the following description of a preferred embodiment when read in conjunction with the accompanying, drawings.

DESCRIPTION OF THE PREFERRED EMBODIMENTS

Figure 1:
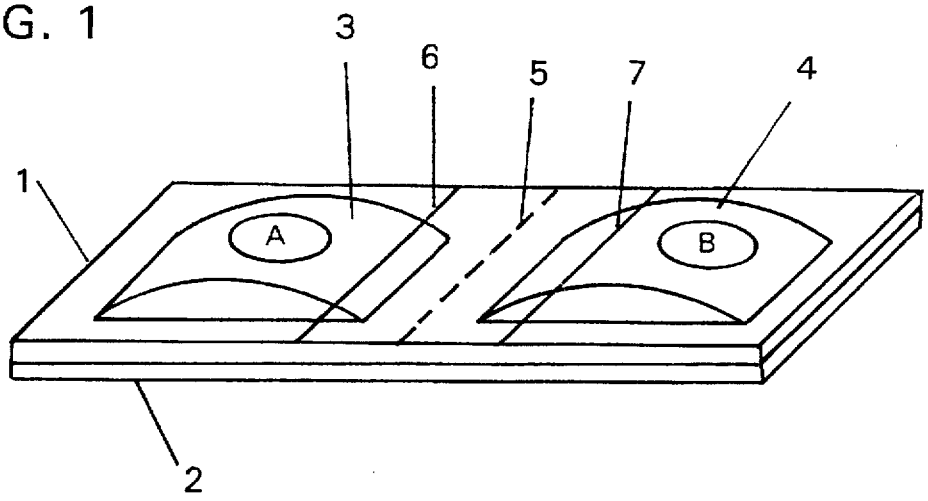
FIG. 1 is a package showing a first embodiment of the invention in which a bleach puck and a detergent block are sandwiched between two packaging layers.

Reference will now be made in detail to the presently preferred embodiments of the invention.

The invention comprises a package for holding two incompatable solids. While the preferred incompatible solids are a bleach block and a detergent block, the solids can be any two solids that interact in the solid phase in an undesired manner. Solids that are intended to react only upon use are also within the scope of the invention.

The particular type of solid is not critical, although crystalline solids are generally more reactive than amorphous solids. And, the package of the invention will more typically be used with more reactive solids, simply due to cost considerations.

In the preferred embodiment, the bleach puck comprises a bleaching agent, although other active compounds are also encompassed within the scope of the invention. The bleaching agent is preferably a halogen bleaching agent, and most preferably a chlorine bleaching agent. One preferred bleaching agent is a halogenated hydantoin, such as halogenated dimethyl hydantoin or halogentated methyl ethyl hydantoins. Preferred bleach pucks comprise a mixture of hydantoins, which are less expensive than pure hydantoins. The bleach puck may also include other ingredients that may or may not interact with other solid materials.

The hydantoin preferably comprises from about 50% to about 80% by weight of the bleach puck; more preferably from about 55% to about 75% by weight. In a more preferred embodiment, the hydantoin comprises from about 60% to about 70% by weight, and most preferably about 65% by weight of the bleach puck.

Other ingredients present in the puck include hydrated alumina ($Al_2O_3 \cdot 3H_2O$). Alumina that is more or less hydrated may be used, but anhydrous alumina is more expensive and more hydrated alumina can lead to processing and handling problems.

The alumina preferably comprises from about 15% to about 45% by weight of the bleach puck, and more preferably about 20% to about 40% of the puck. Even more preferably, the alumina comprises from about 25% to about 35% by weight of the puck, and most preferably about 30% by weight.

The bleach puck may also contain up to about 15% by weight of a dissolution rate controlling agent, such as sodium chloride or sodium bicarbonate. While the preferred agent is sodium chloride, other known dissolution control agents can be used.

In addition to the foregoing, the bleach puck may also contain minor amounts of other ingredients, such as mold release agents, binders and fillers.

The detergent block preferably comprises surfactants for cleaning and some form of indicator, such as a dye or a fragrance, to provide sensory evidence of the presence of the active ingredients and to inform the consumer that the product has been exhausted by the absence of color or fragrance. Preferably, the detergent ingredient or ingredients comprise from about 35% by weight to about 75% by weight of the block, more preferably from about 45% to about 65% by weight of the cube, and most preferably about 55% by weight of the cube. Dyes and fragrances may each comprise up to about 20% by weight of the cube, although 15% or less by weight is preferred for dyes and 5% or less by weight for fragrances is preferred. Other ingredients include chelating agents, solubility control agents, plasticizers and preservatives. All of these ingredients are well known in the art, and the selection of any particular ingredient is well within the ordinary skill in the art.

As with the bleach puck, however, the detergent block may be any solid material that has some ingredient that is adversely affected by some ingredient in the other solid material. In the case of the preferred detergent block, the dye is discolored and adversely affected by the presence of the chlorine in the hydantoin of the beach puck. Surprisingly, however, the dye is unaffected by the relatively low levels of chlorination found during typical use in the cistern and bowl.

During use, the combination of the puck and the cube release active ingredients independently into the tank. The two ingredients must be matched in size and configuration to supply effective amounts of both sets of active ingredients at appropriate and consistent levels for the life of the product. In addition, the puck and the cube must be used up at approximately the same time, so that left over materials do not interfere with the performance of the next combination product placed into the tank. Selecting the proper sizes and configurations to achieve these goals depends on the exact characteristics of the puck and the cube, on the anticipated duration of the product in the tank, and even the frequency of flushing associated with the individual toilet.

The chorine puck should be configured to deliver from about 0.50 ppm to about 2.00 ppm chlorine to the toilet bowl on a consistent basis. More preferred is about 0.75 ppm to about 1.00 ppm chlorine, and most preferred is about 0.75 ppm chlorine. If too much chlorine is present in the bowl, it can discolor the dye, and if not enough chlorine is present, the cleaning efficacy of the product is reduced.

If the detergent cube contains dye that is affected by the presence of chlorine, the detergent cube should supply from about 0.05 ppm to about 2.00 ppm of the dye to the bowl, more preferably from about 0.075 ppm to about 1.00 ppm, and most preferably from about 0.10 ppm to about 0.50 ppm of the dye to the bowl. Too much dye will darken the bowl beyond the aesthetic preferences of many consumers, and too little will not be perceptible, especially in frequently flushed toilets.

To accomplish the goals set out above, the preferred composition for the bleach puck is:

| Ingredient | Amount (wt. %) |
|---|---|
| Chlorinated Hydantoins | 65.0% |
| Hydrated Alumina | 30.0% |
| Sodium Chloride | 5.0% |
| Total: | 100.0% |

The preferred formulation for the detergent block is as follows:

| Ingredient | Amount (wt. %) |
|---|---|
| Sodium Lauryl Sulfate (detergent) | 19.0% |
| Cocamide MEA (detergent) | 35.0% |
| Sodium Sulfate (solubility control agent) | 20.5% |
| Sodium Citrate (chelating agent) | 5.0% |
| Pine Oil 70 (fragrance) | 4.0% |
| Isobornyl Acetate (plasticizer) | 2.0% |
| Acid Blue #9 (dye) | 12.0% |
| Sodium Carbonate (solubility control agent) | 2.0% |
| Preservative | 0.5% |
| Total: | 100.0% |

The relative amounts of these two formulations are preferably designed to permit more than one hundred and twenty days of continuous operation. When combinations of different weights were tested, the preferred size ratio to achieve 120 days of operation was about 65 grams of detergent block to about 35 grams of chlorine puck. The size of the detergent block proved to be more important to duration than the size of the chlorine puck, but maintaining the ratio was important to keep the proper relative ratio of active ingredients in the bowl.

During use, it is preferable to separate the bleach puck and the detergent block in the cistern to avoid intimate contact between the two. Dilution of the active ingredients by the water in the cistern reduces the interaction between the two sets of active ingredients, but if the puck and block are too close, the water cannot sufficiently disperse the active ingredients to reduce interactions.

The package of the invention is designed to prevent interaction between the solid ingredients during storage. The active ingredients must be separatated by a physical barrier impermeable to the active ingredients. Preferably, the package also has an outer layer or layers that protect the puck and block from outside contamination. The package may also have an outer carton or other container for purposes of aesthetics and additional protection.

The outer carton may be made using any conventional technique and out of any conventional material, such as cardboard or Kraft paper. The packaging material is preferably flexible plastic, although rigid and semi-rigid materials may also be used. Preferred are materials that are capable of holding a hermetic seal and that are sufficiently strong and durable to withstand the rigors of shipping and storage. Thermoplastic materials, especially thermoplastic polymers, are preferred due to the ease of working with such materials, but the invention is not limited to thermoplastic polymers.

The invention may be better appreciated by reference to the attached drawings.

FIG. 1 shows a package made in accordance with the invention. The package has an upper layer 1 and a lower layer 2. Upper layer 1 may have preformed pockets or may be made of a flexible material. Incompatible solids A and B are placed on bottom layer 2 or within the pockets 3 and 4 formed in upper layer 1. After the solids are properly placed, upper layer 1 and bottom layer 2 are sealed together, preferably hermetically. The upper layer and lower layer may be joined by heat sealing, by adhesive or by some other technique known in the art.

The package is then preferably folded at line 5 and either marked or scored with cut lines 6 and 7, which are preferably disposed substantially the same distance away from fold line 5. The packaging may take place on a fully or partially automated packaging line, using equipment well known in the art, such as Siebler, Bartelts, Koch, Mahaffey and Harder machines.

The cut lines 6 and 7 may simply be visual indicators superimposed on the package by, for example, marked lines on a tape or adhesive strip applied to the package or printed on the package material. The package may be folded by the consumer or folded and secured using glue or tape.

When the product is used by the consumer, the top of the toilet cistern is removed, exposing the cistern. The two pouches may then be opened simultaneously, by cutting or tearing across cut lines 6 and 7, while the package is folded along line 5. The solids, which up to the time of use have been separately packaged, may now be dropped into the cistern simultaneously or within a short time of each other, since cutting or tearing will separate the two pouches 3 and 4. The puck and the block may be dropped into different ends of the cistern, to reduce the interaction that might otherwise occur. The top of the cistern is then replaced, and the product has been placed in the cistern with no physical contact between the solids and with no contact between the puck or block and the user.

Figure 2:
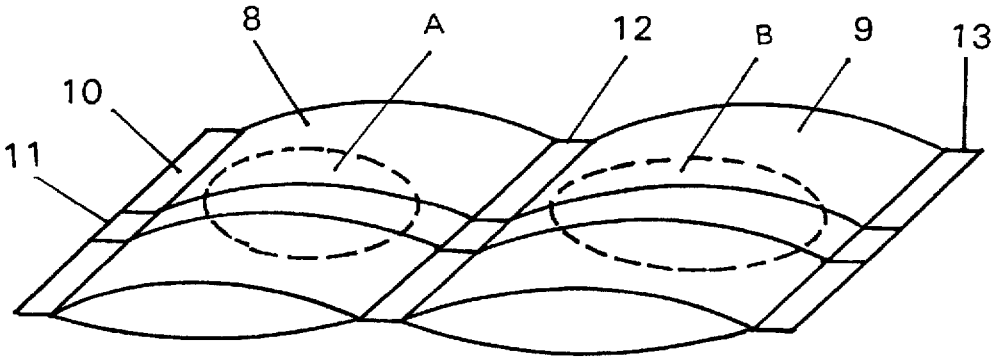
FIG. 2 is a package showing a second embodiment of the invention in which a bleach puck and a detergent block are wrapped in packaging material that is subsequently sealed.

A second embodiment of the invention is shown in FIG. 2. In FIG. 2, a fully flexible packaging material is wrapped around solids A and B separately, defining pouches 8 and 9 around solids A and B. The pouches are separated by seal 12, which may be a hermetic seal, and are sealed from the outside world by seals 10, 11, and 13. In operation, the solids are wrapped in the packages and seals are applied later in a continuous process. Hermetic seal 12 and the surrounding evirons may be marked or scored with cut lines and fold lines as shown in FIG. 1.

Figure 3:
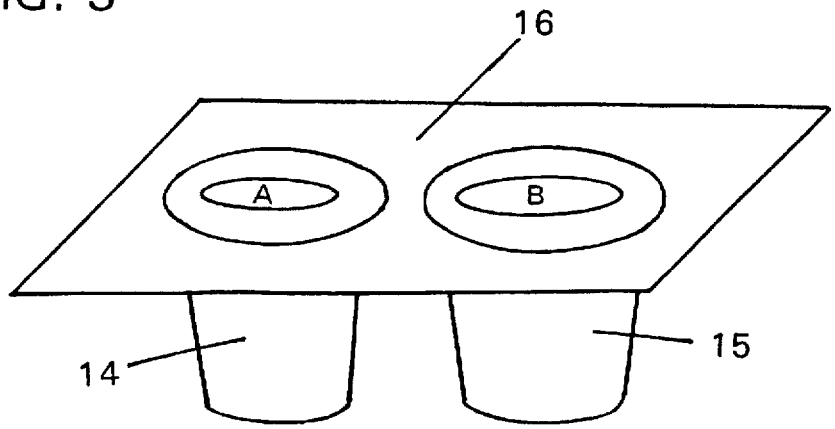
FIG. 3 is a package showing a third embodiment of the invention in which the bleach puck and the detergent block are placed in separate cups with a single adhesive cover layer (not shown).

FIG. 3 shows another embodiment of the invention in which incompatable solids A and B are separately placed in cups 14 and 15 in a preformed plastic holder. The holder preferably has an extended lip or shelf 16 disposed at the entrance of cups 14 and 15. The lip or shelf is covered by a flexible, adhered, peelable upper layer or a coated board (not shown) that may have a tab or overhanging portion to enable the consumer to peel back the upper layer to expose solids A and B for use.

Since the interior of the two cups are exposed by the removal of the upper layer, no score lines or cutting guides are needed with the embodiment set forth in FIG. 3.

Figure 4:
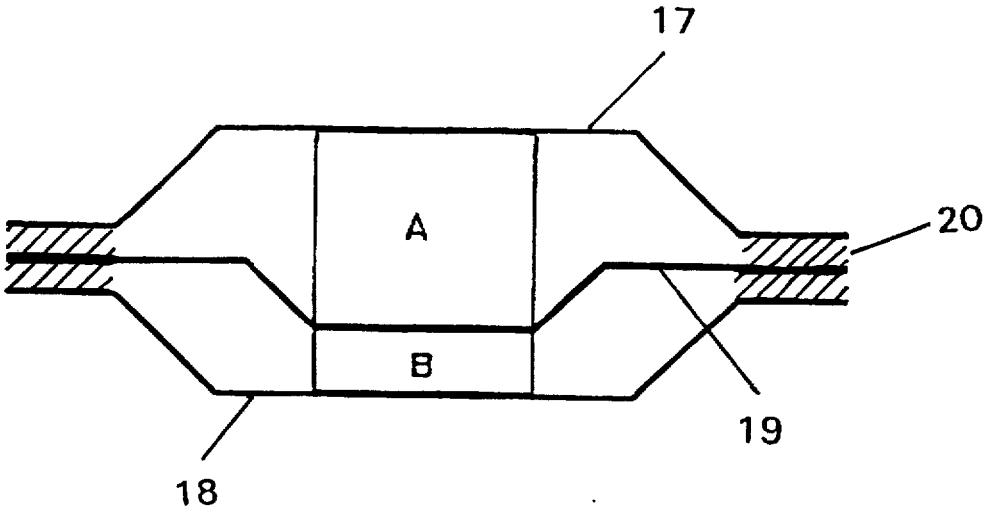
FIG. 4 is a package showing a fourth embodiment of the invention in which a bleach puck and a detergent block are vertically stacked in a single package, separated by a preformed divider designed to accomodate the differing sizes of the materials.

FIG. 4 shows an cut-away side view of another embodiment of the invention. In FIG. 4, an upper layer 17 and a lower layer 18 have an intermediate layer 19 sandwiched between them to define two separate chambers or pouches. The three layers are held in relative location by adhesive or seal 20, which seals both pouches from each other and from outside contation.

One advantageous feature of the embodiment shown in FIG. 4 is that all or any of the layers 17, 18 or 19 may be "preformed" to receive solid A or solid B. This feature is especially important when solids A and B are of different size, since high speed packaging lines might otherwise experience difficulties controlling placement of the solids and difficulties resulting from distortion of materials used in layers 17, 18 and 19.

The package is preferably made out of a flexible, formable polymer. One preferred polymer film is a laminated Valeron® film supplied by Union Camp and American Packaging. Valeron® polymer film comprises a cross laminate of high density polyethylene. The laminate (from outside in) preferabley comprises an overlayer, print, Valeron® film, linear low density polyethylene, and Surlyn® film. Surlyn® film is a product of DuPont and is used as the sealing adhesive.

Other materials are certainly available for use, and the foregoing description should not be construed as an admission that the invention is limited to any one laminate, polymer or material.

The purpose of the above description is to illustrate some embodiments of the present invention without implying a limitation. It will apparent to those skilled in the art that various modifications and variations may be made in the apparatus or procedure of the invention without departing from the scope or spirit of the invention.

What is claimed is:

1. A retail package for preventing contact between at least two solids that are incompatible when in mutual contact, comprising:

(a) a first hermetically sealed pouch;

(b) a first active solid in said first pouch;

(c) a second hermetically seach pouch; and (d) a second active solid in said second pouch;

wherein said first pouch and said second pouch are separated by a shared, preformed wall, said first pouch and said second pouch are capable of being opened simultaneously, said first solid is of a substantially different size than said second solid and wherein said first solid comprises an oxidising agent and said second solid comprises a coloring agent or a detergent or both.

2. An automatic toilet bowl cleaner delivery system comprising:

(a) a non-flowable bleach puck comprising at least one bleaching agent;

(b) a non-flowable detergent block comprising at least one fragrance or dye adversely affected by said bleaching agent; and (c) a compartmentalized package that separates said detergent block from said bleach puck during storage, wherein said bleach puck and said detergent block are not in substantial contact in the tank of a toilet during use.

3. The system of claim 2, wherein said bleach puck comprises at least one halogenated hydantoin.

4. The system of claim 2, wherein said detergent block comprises at least one dye.

5. The system of claim 4, wherein said bleach puck comprises at least one halogentated hydantoin.

6. The system of claim 5, wherein said bleach puck comprises from about 35% by weight of the combined weight of said bleach puck and said detergent.

* * * * *